United States Patent [19]

Undin

[11] 4,048,877

[45] Sept. 20, 1977

[54] DEVICE, PARTICULARLY OF THE PLIERS OR SCISSORS TYPE

[75] Inventor: Hans Undin, Akersberga, Sweden

[73] Assignee: Pressmaster Ltd., Stockholm, Sweden

[21] Appl. No.: 647,437

[22] Filed: Jan. 8, 1976

[51] Int. Cl.[2] ..... B21D 9/00; B25B 7/02

[52] U.S. Cl. ..... 81/313; 29/751; 72/410; 81/383.5

[58] Field of Search ..... 72/409, 410; 29/203 H, 29/750, 751, 758; 81/313, 383.5

[56] References Cited

U.S. PATENT DOCUMENTS

| | | | |
|---|---|---|---|
| 2,616,316 | 11/1952 | Dupre | 81/383.5 X |
| 2,822,715 | 2/1958 | Raimondi | 81/383.5 X |
| 2,836,089 | 5/1958 | Davies | 72/410 |
| 3,029,670 | 4/1962 | Over et al. | 29/203 H |
| 3,630,068 | 12/1971 | Floyd | 72/410 |

FOREIGN PATENT DOCUMENTS

| | | | |
|---|---|---|---|
| 329,571 | 9/1935 | Italy | 81/383.5 |

*Primary Examiner*—Leon Gilden
*Attorney, Agent, or Firm*—William Anthony Drucker

[57] ABSTRACT

A tool with a variable force transmission ratio between the handles, which receive the driving force, and the working jaws adapted to perform the desired work, comprising a first stationary working jaw and a second movable working jaw journalled in a first pivot point to the first jaw, having an elongated cam profile arranged beyond said first pivot point and with the exception of eventual adjustments fixedly connected with and extending essentially in the same direction as the first jaw, the second jaw being prolonged beyond said first pivot point by an extension to which an operative means for receiving the driving force is journalled in a second pivot point spaced from the first pivot point, which operative means is rigidly connected to contact means arranged in such a manner that when the operative means are actuated by a driving force the contact means is pressed against the cam profile and made to follow it.

7 Claims, 3 Drawing Figures

Fig. 1

DEVICE, PARTICULARLY OF THE PLIERS OR SCISSORS TYPE

BACKGROUND TO THE INVENTION

1. Field of the Invention

This invention relates to a device (hereinafter referred to as a "device of the kind specified"), particularly a tool of the pliers or scissors type, where it is desired that the force transmission ratio between the means which receive the driving power, such as a pair of manually operated handles in the case of pliers or scissors, and the means which perform the desired function such as cutting, pressing or the like, may be variable during the operation. As an example of a device of the kind specified so called crimping pliers may be named, which are a tool for crimping terminals provided with crimping barrels, so called ferrules, on the end of electrical wires or cables.

It is obvious that at the beginning of the crimping operation a smaller force is generally needed for the initial deformation of the crimping barrel than in the final stage, when the crimping barrel has to be tightly pressed towards the cable end to establish a reliable connection, electrical as well as mechanical. It is therefore preferable if the tool in the initial stages may be operated with a greater force transmission ratio than in the final phase, i.e., that at the end of the operation a smaller but stronger angular movement of the crimping jaws shall correspond to a given angular movement of the handles, executed with the same power, than at the beginning.

2. Description of the Prior Art

Various solutions of this problem have already been considered. It has been proposed in a vice-type tool with one rectilineary movable jaw (Swedish Pat. No. 205,961) to drive this jaw with the aid of a toggle joint mechanism where the free end of one link scans a cam surface on the inner edge of the movable handle. The solution is practicable only with vice-type tools and toggle joint mechanisms are in general rather complicated (expensive). A wire cutting tool has been proposed (U.S. Pat. No. 2,311,695) which is provided with such a lever arrangement that the force applied to the cutting elements or cutting jaws gradually increases as the cutting elements are moved together in accordance with the increase in resistance to cutting when the cut in the wire is increased. The arrangement is very bulky and demands a complicated lever system. Other known solutions of the problem are represented by tools, e.g., according to U.S. Pat. Nos. 1,820,169, 2,520,905, 3,273,240 or 3,390,455, where the increase in the cutting force or other active force occurs stepwise by a pawl jumping from one tooth to another in a rectilinear row of ratchet teeth. The pawl means and/or the teeth means require a separate lever organ, thus creating also a lever system, even if of somewhat simpler construction than according to the previously mentioned solution. The main drawback of the pawl-and-ratchet-solution is however the necessity to release the tension every time a force increasing jump of the pawl has to be executed, which makes this solution clearly unsuitable for many practical applications where continuous and/or continuously increasing action force is demanded.

SUMMARY OF THE INVENTION

It is an object of the present invention to provide an improved device for the above-mebntioned or similar purposes.

According to the present invention, a device of the kind specified comprises two functional means such as a pair of working jaws or the like adapted to perform the desired work, comprising a first stationary working jaw and a second movable working jaw journalled in a first pivot point to the first jaw, and is characterized by an elongated cam profile arranged beyond said first pivot point and with the exception of eventual adjustments fixedly connected with and extending essentially in the same direction as the first jaw, the second jaw being prolonged beyond said first pivot point by an extension, to which an operative means for receiving the driving force is journalled in a second pivot remote from the first pivot point, which operative means is rigidly connected to a sensing or contact means arranged in such a manner that when the operation means is actuated by a driving power, the contact means is pressed against the cam profile and made to follow it.

Besides being made adjustable in its position relative the first jaw, the cam profile may preferably also be made exchangeable for a cam profile of another configuration. The adjustability may preferably be achieved in such a way that the cam profile is executed as one edge of a plate which at one end is journalled to a piece which is integral with or rigidly connected to the first jaw. At the opposite end the plate cooperates with some per se known device for fixation in a number of chosen angular positions relative said piece.

With a view to ensuring that the considered operation is always properly completed, it is usual to provide devices of the kind specified with some sort of a safety device in the form of a motion-imparting or -compelling mechanism which basically consists of a ratchet which remains engaged by a pawl — and thus prevented from performing a return movement — until the desired relative movement of the two jaws has been completed.

According to the present invention, such a ratchet-and-pawl-type motion-compelling mechanism preferably may be executed in the form of a row of ratchet teeth disposed at the end of the extension of the second jaw along an arcuate line having its center of curvature coincident with the second pivot point, a pawl being pivotally mounted on the operating means and actuated by spring means to be maintained in engagement with the ratchet teeth as the operating means is actuated by the driving force, thus preventing opening of the jaws until the pawl has traversed the row of teeth.

It is obvious that the present invention may be realized either as a portable and hand operated tool of the already named pliers or scissors type, or as a stationary device, e.g., fixedly disposed on a working desk and either operated manually or by means of a pressure fluid or the like which over a piston-and-cylinder-unit actuates the operating means of the device.

In the embodiment as a pliers type tool, the part which is integral with or rigidly connected to the first jaw preferably is the first handle means of the tool, and the operating means which is journalled to the extension of the second jaw is preferably the second handle means of the tool, the cam profile being disposed in or at the first handle means and the contact means being integral with or rigidly connected to other handle means, and- /or preferably provided with a roller for smoother gliding along the cam profile.

DESCRIPTION OF THE PREFERRED EMBODIMENT

Figure 1:
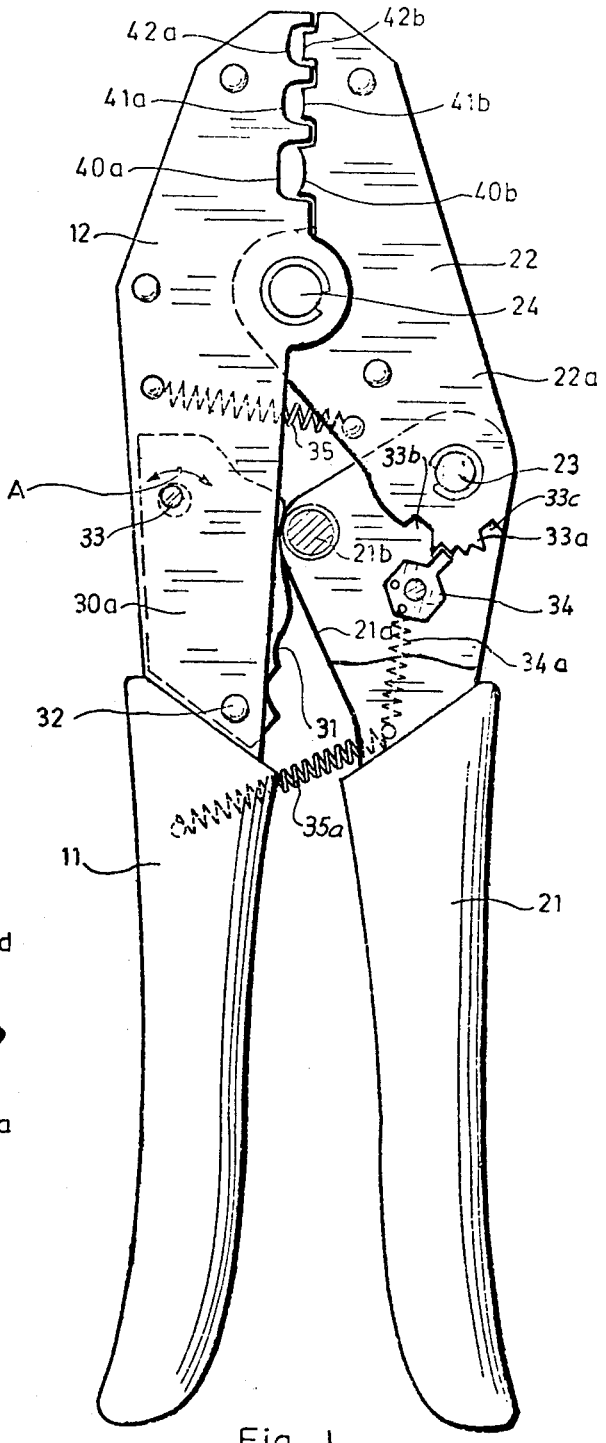
FIG. 1 is a side view of the pliers in closed position.

Referring to FIG. 1, the pair of pliers has a stationary first working jaw 12, and a movable second working jaw 22. The first jaw 12 is provided with an extension in the form of a first handle 11 connected thereto, and extending essentially in the same direction as the first jaw. The movable working jaw 22 is journalled to the first jaw in a first pivot point, represented by a tap 24, intermediate the first jaw 12 and the handle 11. The jaws 12, 22 are provided with three pairs of crimping dies 40*a*, 41*a*, 42*a* and 40*b*, 41*b*, 42*b*. The second jaw 22 is beyond the first pivot point 24 provided with an extension 22*a* at the end of which a second pivot point 23 is arranged. A second handle 21 has a substantially U-formed cross-section with two parallel side walls and is pivoted to the extension 22*a* at the second pivot point 23. The front part of the upper side has been broken away in the drawing for greater clarity. The second handle 21 is provided at its inner periphery, intermediate the second pivot point and the rear terminal portion of the handle with a projection 21*a* acting as cam follower means for the cam profile 31. To facilitate the contact, a roller 21*b* is disposed at the projection 21*a*.

At the inner periphery of the first extension, that is along the first handle 11, or inside this handle, if it also has a U-shaped cross-section, there is arranged a cam profile 31 formed by the upper edge of a plate 30*a* journalled on a tap 32 intermediate the tap 24 and the rear terminal portion of the handle 11. At the front end of plate 30*a* (upper end in the drawing) an adjustment device of some known type, e.g., an eccentric means 33, for fixing the plate 30*a* in a chosen angular position relative leg 11 is arranged. The angular adjustment movement is represented by the double arrow A.

In use, actuation of the second handle 21 causes the roller 21*b* to be pressed against the cam profile and to follow it so that the rear terminal portion of the second extension is moved away relative to the cam profile to an extent which is defined by the shape of the cam profile.

Figure 3:
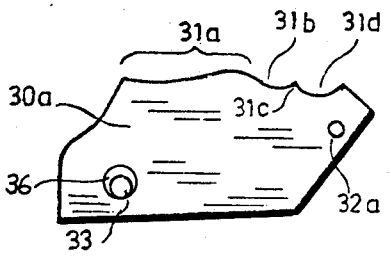
FIG. 3 is a side view of a guide plate with a cam profile.

At the rear end (lower end in the drawing) of the extension 22*a*, a row of ratchet teeth 33*a* is disposed along a curved line the center of curvature of which lies on the axis of the tap 23 embodying the second pivot point. On the second handle 21 a pawl 34, tensioned by a spring 34*a*, is pivotally mounted for engagement with the ratchet teeth 33*a*. The function of this pawl-and-ratchet motion-compelling device is conventional, the novel feature being mainly the location and arrangement of the ratchet teeth. A tension spring 35 urges the tool into its open position. In FIG. 3 is shown more in detail the plate 30*a* the upper edge of which is the cam profile 31. The primarily functional part of the cam profile 31 is the frontward section 31*a* formed in such a way that the desired variation of the force transmitting ratio is achieved. It is obvious that according to the exigencies of any particular case, i.e., the desired degree of variation, a plurality of individually calculated curves are available for section 31*a*.

According to an embodiment of the invention, section 31*a* is rearwardly followed by one, but preferably two or even more recesses 31*b*, 31*d* separated by a short crest 31*c* between them. The purpose of this arrangement is to give the tool a well defined end position in the open state or, preferably two or more such end positions. When for performing a specific task the working jaws 12, 22 need not be separated one from another to the full extent, the handles 11, 12 are opened only as far as contact means 21*a*, 21*b* fits into the first recess 31*b*. The handles are then only partially open and it takes less time to execute the closing operation. If however, the jaws 12, 22 have to be opened wholly, the handles are opened till the contact means fits into the second recess 31*d*. Tension spring 35*a* assures uninterrupted contact between the contact means 21*a*, 21*b* and the cam profile 31 during the whole opening operation. With more than two recesses such as 31*b*, 31*d* more than two well defined end positions are achieved. Opening 32*a* receives the tap 32 and opening 36 the adjusting eccentric means 33.

Figure 2:
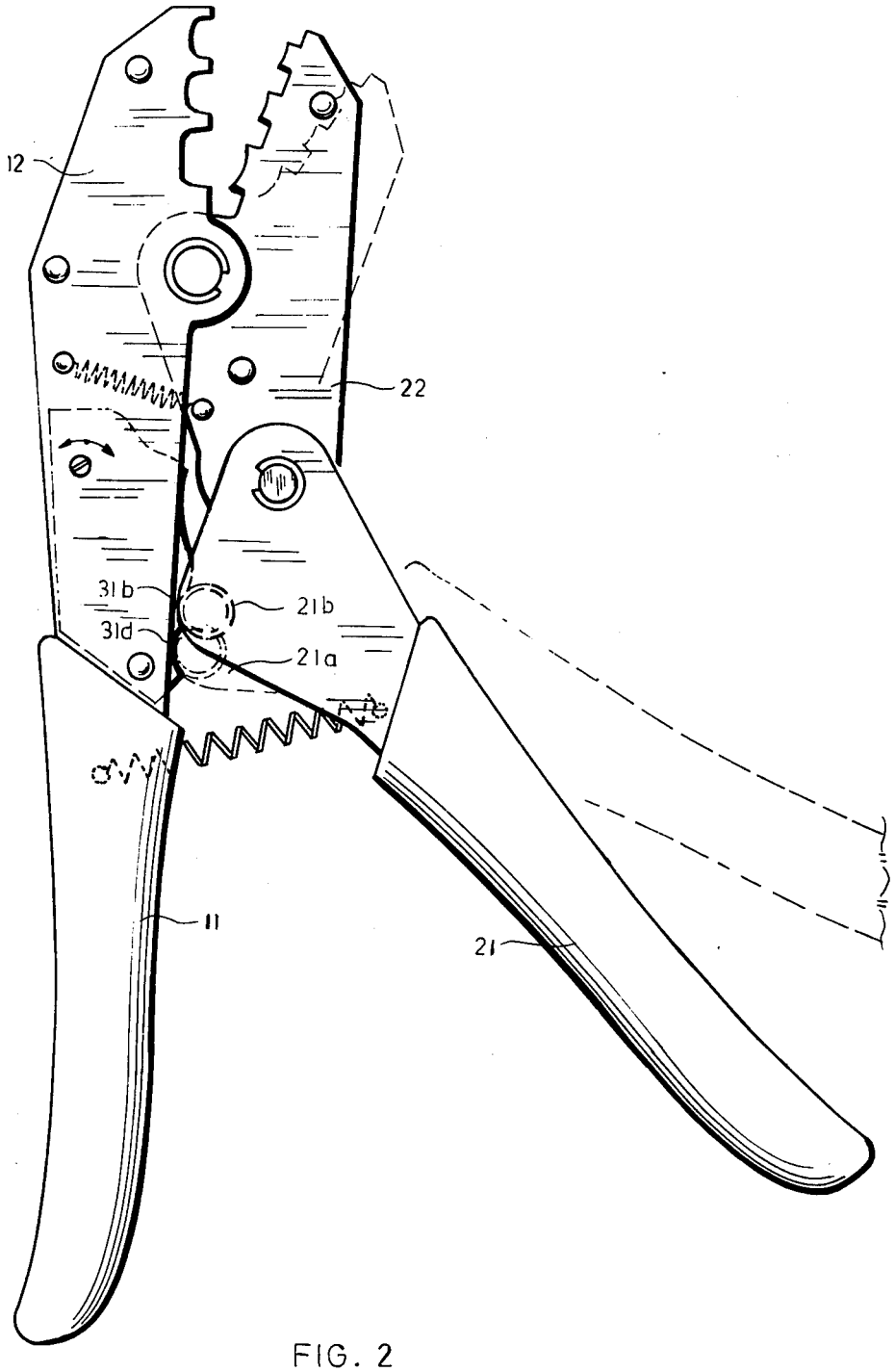
FIG. 2 is a side view of the same pliers in open position.

FIG. 2 corresponds essentially to FIG. 1, but shows the pliers in their first end position in the open state. In phantom, with broken lines, the position of the contact means 21*a*, 21*b* also in the second end position and the corresponding even more open position of the handles 11, 21 and jaws 12, 22 is shown.

The pawl and ratchet device is a modification of a device known per se and having then the ratchet in the form of a rectilinear rack. On both sides of the row of teeth a release gap 33*b*, 33*c* is arranged. The pawl 34 is adapted to prevent an opening movement as long as it is in engagement with the row of teeth 33*a*, but to allow then a closing movement jumping from one tooth gap to the next. The tool is opened from the position shown in FIG. 1 by further pressing the handles 11, 21 together. The pawl jumps from the last tooth gap into the lower release gap 33*b*, is there by its spring 34*a* turned in such a way as to clear the row of teeth 33*a*, so that the handles can be opened, and the pawl or its projection comes to rest in the upper release gap 33*c*. Upon closing, the jumping along the row of teeth recommences.

The exact geometrical form of the cam profile does not need to be described because the calculative or empirical establishing of the profile is not difficult. In the first phase of the closing movement, the roller 21*b* follows the "uphill" part of section 31*b* (FIG. 3) and to a certain angular movement of the handles a relatively large angular movement of the jaws corresponds. When the top between sections 31*b* and 31*a* has been overcome, increasingly smaller angular movements of the jaws corresponds to a given angular movement of the handles, i.e., the force transmission ratio increases. By adjustment of the eccentric 33 the extent to which the jaws are closed one upon another in the final position is established. In FIG. 1 by adjusting said eccentric, the pertinent end of the cam profile 31 and consequently also the roller 21*b* will move to the left or to the right in the drawing.

I claim:

1. A tool comprising i. a stationary first working jaw, ii. a first extension having an outer periphery, an inner periphery and a rear terminal portion and being rigidly connected to and extending essentially in the same direction as the first jaw, iii. a movable second working jaw, journalled to the first jaw in a first pivot point located intermediate the first jaw and the first extension, iv. an elongated cam profile arranged at the inner periphery of the first extension intermediate the first pivot point and the rear terminal portion of the first extension, v. a second extension formed on the second jaw on the reverse side from the first pivot point than where the second jaw is located and having an outer periphery, an inner periphery and a rear terminal position, vi. an elongated drive means having an outer periphery, an inner periphery and a rear terminal portion and being journalled to the second extension in a second pivot point located in the rear terminal portion of the second extension, vii. a cam follower means arranged at the inner periphery of the drive means, intermediate the second pivot point and the rear terminal portion of the drive means, and adapted, when the drive means is actuated by a driving force, to be pressed against the cam profile and to follow it so that the rear terminal portion of the second extension is moved away relative to the cam profile to an extent which is defined by the shape of the cam profile.

2. A tool according to claim 1, in which the cam profile is removable from said first extension, whereby when the cam is removed a cam having a different profile can be inserted.

3. A tool according to claim 1 in which the said first extension is defined by a first handle, the drive means are in the form of a second handle and the cam follower means is in the form of a projection formed on the inner periphery of the second handle.

4. A tool according to claim 3 provided with a pawl-and-ratchet safety device for preventing incomplete operation, characterized by a row of ratchet teeth disposed at the said rear terminal portion of the second extension, on the rearward edge thereof, along an arcuate line having its center of curvature coincident with the second pivot point, and a pawl pivotally mounted on the second handle and actuated by a spring means to be maintained in engagement with the ratchet teeth as the handles are closed upon each other, thus preventing opening of the handles until the pawl has traversed the whole row of teeth.

5. A tool according to claim 1 in which the cam follower means includes a roller for smoother gliding along the cam profile.

6. A tool according to claim 1 in which the cam profile is adjustably arranged on said first extension.

7. A tool according to claim 4 in which the cam profile is defined by an edge of a plate, one end of the plate being journalled to said first extension and an opposite end of the plate being provided with means for fixing the plate in a series of different positions relative to the extension.

* * * * *

UNITED STATES PATENT AND TRADEMARK OFFICE

CERTIFICATE OF CORRECTION

PATENT NO. 4,048,877

DATED September 20, 1977

INVENTOR(S) : HANS UNDIN

It is certified that error appears in the above-identified patent and that said Letters Patent are hereby corrected as shown below:

After [22] and before [51] insert

[30] FOREIGN APPLICATION PRIORITY DATE

March 25,1975 SWEDEN .....75/03414

Signed and Sealed this

*Seventeenth* Day of *October 1978*

[SEAL]

*Attest:*

RUTH C. MASON
*Attesting Officer*

DONALD W. BANNER
*Commissioner of Patents and Trademarks*